US005698940A

United States Patent [19]

Ballato et al.

[11] Patent Number: 5,698,940

[45] Date of Patent: Dec. 16, 1997

[54] METHOD FOR DETRAPPING LIGHT IN THIN FILM PHOSPHOR DISPLAYS

[75] Inventors: Arthur Ballato, Oceanport; David C. Morton, Eatontown, both of N.J.

[73] Assignee: The United States of America as represented by the Secretary of the Army, Washington, D.C.

[21] Appl. No.: 589,922

[22] Filed: Jan. 23, 1996

[51] Int. Cl.[6] ..... H01J 29/89

[52] U.S. Cl. ..... 313/479; 313/478; 313/112; 313/473

[58] Field of Search ..... 313/479, 463, 313/466, 470, 471, 473, 478, 112, 116; 348/832, 835; 359/580, 581

[56] References Cited

U.S. PATENT DOCUMENTS 4,972,117 11/1990 Adler et al. ..... 313/478
5,061,874 10/1991 Hecq et al. ..... 313/479 X
5,099,171 3/1992 Daiku et al. ..... 313/479
5,539,275 7/1996 Armoto et al. ..... 313/473 X

OTHER PUBLICATIONS

Stevens, R. et al., "Enhancing the Brightness of Thin-Film Electroluminescent Displays by Improving the Emission Process", *IEEE Device Letters*, vol. 15, No. 3, Mar. 1994.

*Primary Examiner*—Ashok Patel
*Attorney, Agent, or Firm*—Michael Zelenka; William H. Anderson

[57] ABSTRACT

In the faceplate of a cathode ray tube or in an FED the amount of light emanating from the phosphor that reaches a viewer is increased by the use of internal and external antireflection layers and concavities between layers on the side of the viewer with respect to the phosphor layer.

5 Claims, 4 Drawing Sheets

METHOD FOR DETRAPPING LIGHT IN THIN FILM PHOSPHOR DISPLAYS

GOVERNMENT INTEREST

The invention described herein may be manufactured, used, sold and/or licensed by or for the Government of the United States of America without payment to us of any royalty thereon.

FIELD OF THE INVENTION

This invention relates in general to displays utilizing a thin film of phosphor.

BACKGROUND OF THE INVENTION

Thin film display devices, FED's, are known in which light is generated in a thin film of phosphor material under the control of arrays of parallel electrodes on opposite surfaces thereof that are orthogonally oriented with respect to each other. One array is usually formed on one side of a glass faceplate through which the image is viewed and the other array is reflective. Light is generated at desired points in the phosphor film by applying voltages between electrodes of the array that cross each other at those points. Cathode ray tubes also use a thin film of phosphor to generate light forming an image. One side of the phosphor is adhered to the inside surface of a faceplate, the other side has a conductive film on it, and the image is generated by scanning an intensity modulated cathode ray beam over the conductive film.

The problem in displays which use thin film phosphors is that there are changes in the index of refraction from layer to layer in the devices. Basic optics shows that when going from a high index material to a lower index material only some of the light will pass through and the rest will be internally reflected. If there is a large change in the index, a high percentage of the light generated will be internally reflected and trapped.

Typically, the solution to this problem is to roughen the surface of the films. The disadvantage of the roughened surface approach is that it decreases the contrast of the displays. This is because incoming ambient light is also scattered. This approach does not allow all of the light to escape; it only improves the detrapping. In the thin film electroluminescent application, the roughening of the surface can reduce the reliability of the device.

Antireflection coatings are known that are comprised of a plurality of layers in which the index of refraction changes by a small amount from layer to layer in a given direction i.e. increasing or decreasing. Such a structure permits nearly all light of interest to pass through it.

SUMMARY OF THE INVENTION

In accordance with one aspect of this invention, antireflection layers are located on the outside of the glass layer through which the image is viewed and between the phosphor layer and the glass. The antireflection layers cause light rays emanating from the phosphor layer to pass into the air at angles much closer to normal than would otherwise be the case and prevents them from being reflected at the phosphor/glass and glass/air interfaces so as to become trapped.

In accordance with another aspect of this invention concavities no greater in size than pixels are formed between the phosphor layer and the glass substrate. The concavities can be shaped to form Fresnel lenses.

DETAILED DESCRIPTION

Figure 1:
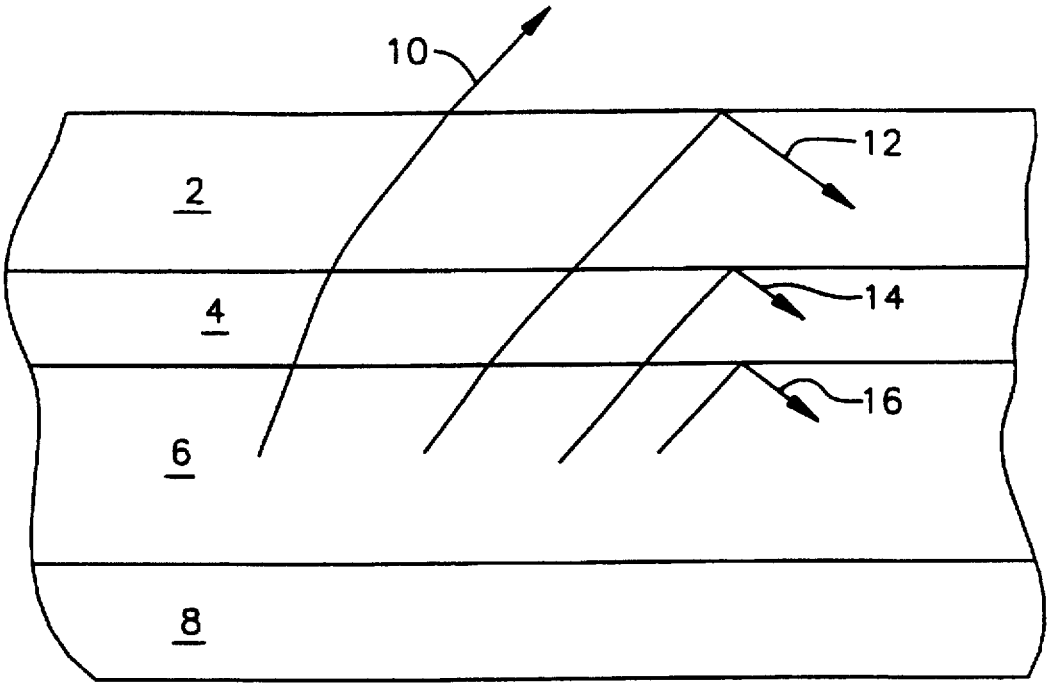
PRIOR ART FIG. 1
FIG. 1 is a cross sectional view of conventional FED or CRT viewing surfaces illustrating the bending of light rays at the interfaces of the various layers therein.

FIG. 1 illustrates the cross section of the viewing screen of a prior art FED or of a prior art CRT having layers 2, 4, 6 and 8. The layer 2 is made of glass, and the layer 6 is comprised of phosphor crystals.

In an FED, the layers 4 and 8 contain respective orthogonal arrays of spaced parallel conductors. Light is produced where the conductors of one array cross the conductor of another if there is a voltage between them. Because the index of refraction of the phosphor layer 6 is greater than the index of refraction of the layer 4 that contains an array of conductors, a ray of light 10 is seen to be bent away from a normal line to the layers when it passes from the layer 6 into the layer 4. The ray 10 is bent still farther from the normal when it enters the glass layer 2 and even farther from the normal when it enters the air above the glass layer 2. A ray 12 of light that approaches the layer 4 at a greater angle with respect to normal than the ray 10 is bent farther from the normal in each of the layers 4 and 2 so as to arrive at the glass/air surface of the layer 2 at an angle in excess of the critical angle and be totally reflected. The initial angle of a ray 14 at the interface of the layers 6 and 4 is such that it strikes the interface of the layers 4 and 2 at an angle in excess of the critical angle and is therefore reflected at their interface. A ray 16 strikes the interface of the layers 6 and 4 at an angle greater than the critical angle so as to be totally reflected at that interface.

In a CRT, the layer 4 would not be present, and the layer 8 would be a thin conductive film, but the bending of the rays 10, 12, 14 and 16 from the phosphor layer 6 would be similar to that shown. The only difference would be that they would pass directly from the phosphor layer 6 into the glass layer 2.

Figure 2:
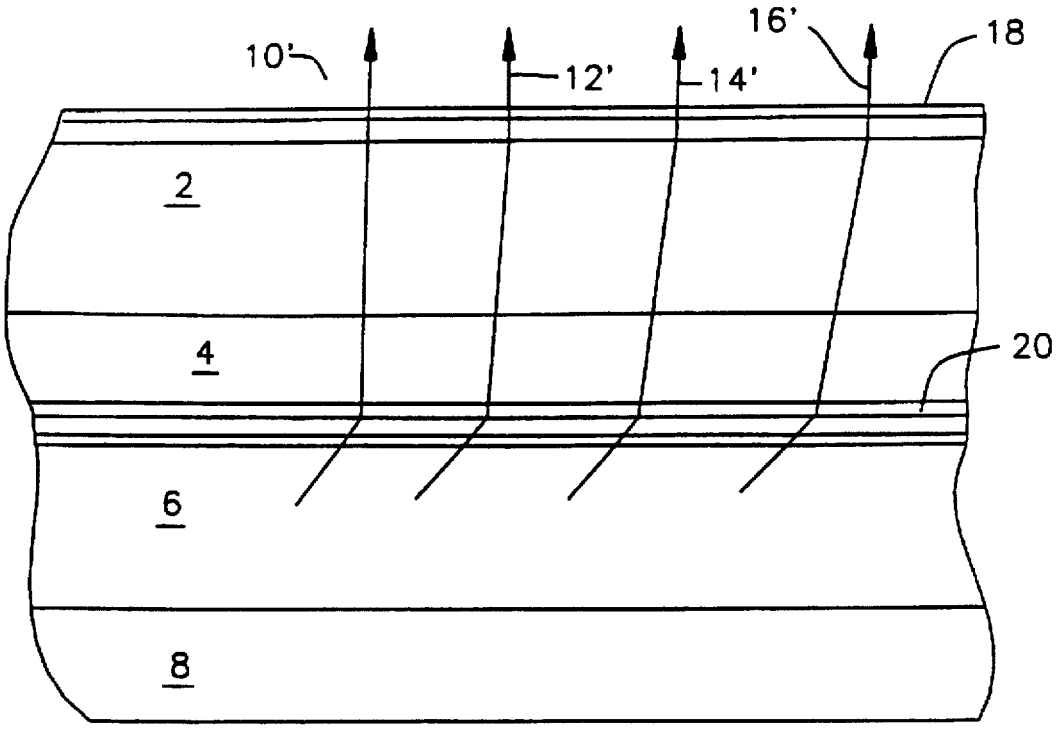
PRIOR ART FIG. 2
FIG. 2 is a cross sectional view of conventional FED or CRT viewing surfaces with two antireflection layers illustrating the reduced bending of light rays resulting from the use of the antireflection layers.

In addition to the structure of FIG. 1, FIG. 2 has an antireflection layer 18 on the upper surface of the glass layer 2 that was previously exposed to air so that the antireflection layer 18 is between the glass layer 2 and air. Another antireflection layer 20 is located between the layers 6 and 4. In FIG. 2, rays 10', 12', 14' and 16' leave the phosphor layer 6 at the same angles as the respective rays 10, 12, 14 and 16 in FIG. 1. By proper design of the antireflection layer 20, none of the rays 10', 12', 14' and 16' will enter the layer 4 at an angle greater than the critical angle so as to be reflected and trapped as was the ray 16 in FIG. 1. This also prevents the reflection of any ray like the ray 14 of FIG. 1 from the interface of the layers 2 and 4. By proper design of the antireflection layer 18 none of the rays 10', 12', 14' and 16' are reflected at the upper surface of the glass layer 2 as was the ray 12 of FIG. 1. And, as can be seen in FIG. 2, all rays 10', 12', 14' and 16' enter the air from the antireflection layer 18 closer to normal than the ray 10 of FIG. 1.

The antireflection layers 18 and 20 operate as follows. If two layers of transparent material have indices of refraction that differ slightly, almost all light will pass through one layer and into the next i.e., there is little or no reflection. By locating a plurality of such layers in which the index of refraction from one layer to the next changes very slightly in the same direction, i.e., increasing or decreasing, between material having considerably different indexes of refraction, light can be made to pass from one material to the other with much smaller angular change. The antireflection layer 18 would be comprised of plurality of thin layers in which the layer in contact with the glass layer 2 would have an index of refraction very close to that of glass, and the layer in contact with the air would have an index of refraction very close to that of air.

The antireflection layer 20 would have a layer in optical contact with the phosphor layer 6 having an index of refraction close to that of phosphor and a layer in optical contact with the layer 4 having an index of refraction close to that of the layer 4. In a CRT, layer 4 is not present, as previously noted, so that the indexes of refraction of the layers of the antireflection layer 20 would vary from a value close to that the index of refraction of phosphor to an index of refraction close to that of glass.

Figure 3A:
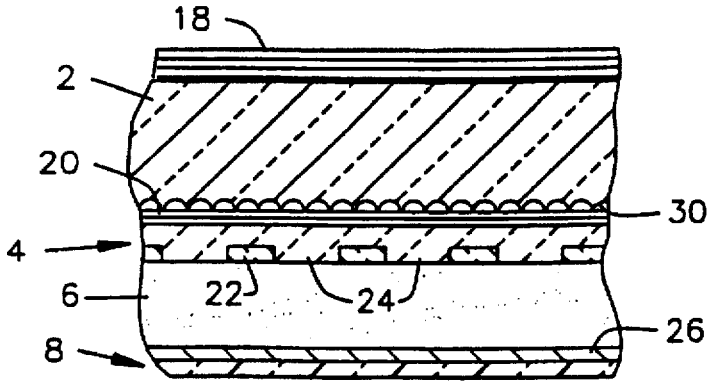
FIG. 3A is a cross section of a viewing surface of a FED having concavities in the inner surface of the glass.
Figure 3B:
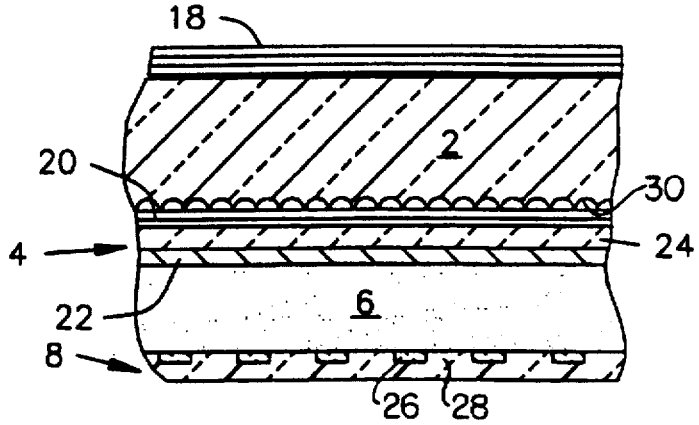
FIG. 3B is a view of what would be seen in a section at a right angle with the section of FIG. 3A so as to better illustrate both arrays of conductors.

In the cross sections of FIGS. 3A and 3B illustrating the structure of a FED display, components corresponding to those of FIG. 2 are designated by the same numbers. In FIG. 3A, the layer 4 of FIG. 2 is comprised of an array of spaced parallel conductive strips 22 shown in end view that are separated from each other by dielectric material 24, and the layer 8 of FIG. 3A is similar to the layer 4 except that its spaced parallel conductive strips 26 are orthogonally oriented with respect to the conductive strips 22. Only one conductive strip 26 is seen in this view. In FIG. 3B, which is a cross section of a FED orthogonal to the cross section of FIG. 3A, the conductive strips 26 appear in end view and are separated by dielectric 28. Only one conductive strip 22 is seen in this view.

Detrapping of light is further enhanced in accordance with the second aspect of this invention in which concavities 30 are formed between the glass layer 2 and the antireflection layer 20. These concavities 30 can be formed by pulses of energy from an excimer laser that would oblate minute focussing cavities in the glass. Thus this is a lateral variation of the spatial geometry as compared to the vertical variation in geometry provided by the antireflection layers 18 and 20. Alternatively, photolithographic techniques could be used to fabricate concavities in the glass layer 2 that are circularly or elliptically symmetric Fresnel lenses.

Figure 4:
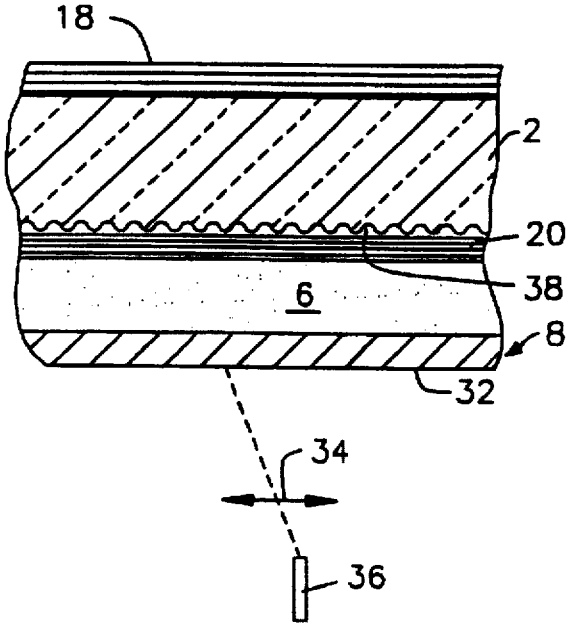
FIG. 4 is a cross section of the viewing surface of a CRT having two antireflection layers and concavities on the inside of the glass.

FIG. 4 is a cross section of the faceplate of a cathode ray tube in which components corresponding to those of FIG. 2 are designated by the same numbers. As previously noted, the layer 4 of FIG. 2 is not present and the layer 8 is a thin conductive layer 32 that is scanned by an electron beam 34 from an electron gun 36. Between the phosphor layer 6 and the glass layer 2 is the antireflecting layer 20, and concavities 38 can be formed between them by methods suggested for forming concavities 30 in FIGS. 3A and 3B.

Figure 5:
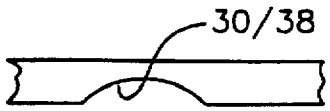
FIG. 5 is an enlargement of a portion of FIG. 4 illustrating one form of concavity.
Figure 6:
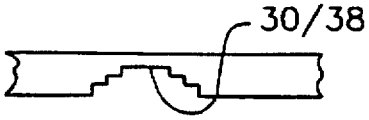
FIG. 6 is an enlargement of a portion of FIG. 4 illustrating a concavity in the shape of a Fresnel lens.

FIG. 5 illustrates a concavitity 30 or 38 that is spherical, and FIG. 6 illustrates a concavity 30 or 38 that is a Fresnel lens.

Figure 7A:
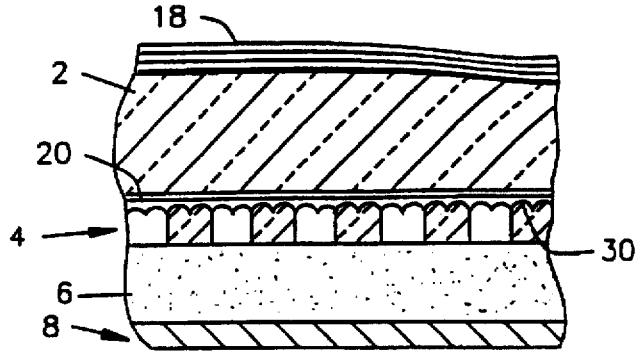
FIG. 7A is a cross section of FED in which concavities are between an antireflection layer and an array of conductors.
Figure 7B:
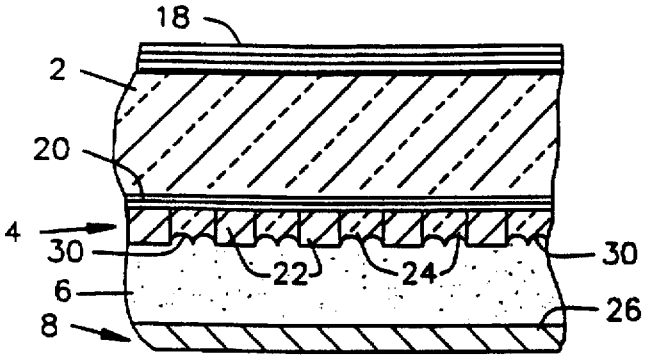
FIG. 7B is a cross section of a FED in which concavities are between an array of conductors and a phosphor layer.
Figure 7C:
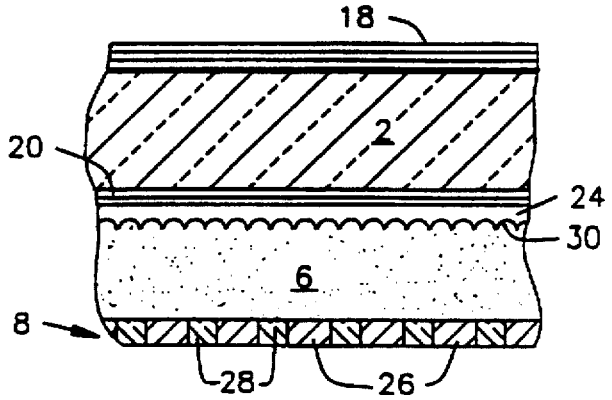
FIG. 7C is a cross section of a FED like that of FIG. 7B taken at a right angle to FIG. 7B.

In view of the fact that the concavities 30 of a FED become more efficient with reduced distance to the phosphor layer 6, they can be formed between the antireflection layer 20 and the array in the layers 4 as shown in FIG. 7A, or they can be foremed between the array in the layer 4 and the phosphor layer 6 as shown in FIGS. 7B and 7C.

Figure 8:
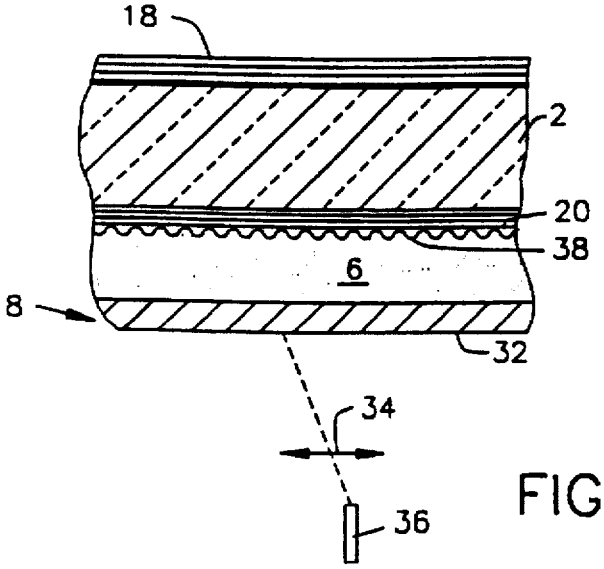
FIG. 8 is a cross section of the face plate of a cathode ray tube in which concavities are between an antireflection layer and a phosphor layer.

In the faceplate of a cathode ray tube, the efficiency of the concavities 38 can be increased by forming them between the antireflection layer 20 and the phosphor layer 6 as shown in FIG. 8.

It is, of course, necessary that all layers be in optical contact with adjacent layers.

What is claimed is:

1. A display device comprising:

a phosphor layer;

means for forming a light image in said phosphor layer;

a glass layer having a first surface facing said phosphor layer, and a second surface remote from said phosphor layer; and a first graduated antireflection coating between said phosphor layer and said first surface, wherein the first antireflection coating is graduated such that a surface of the first antireflection coating adjacent the glass layer has an index of refraction substantially equal to an index of refraction of the glass layer and an index of refraction is graduated throughout the graduated antireflection coating and becomes substantially equal to an index of refraction of the second surface;

a second graduated antireflection layer on the second surface of said glass layer, wherein the second antireflection coating is graduated such that a surface of the second graduated antireflection coating adjacent the second surface of the glass layer has an index of refraction substantially equal to the index of the refraction of the second surface and an index of refraction is graduated throughout the second graduated antireflection coating and becomes substantially equal to an index of refraction of air; and a focusing layer between said glass layer and said phosphor layer, wherein the focusing layer is comprised of a plurality of concavities, each concavity having an open end facing the phosphor layer so as to focus light emanating from the phosphor layer through the second surface of the glass layer to the air.

2. A display device as set forth in claim 1, wherein said concavities are at least as small in a direction parallel to said first surface as a pixel in an image formed in the phosphor layer.

3. A display device as set forth in claim 1, wherein said means for forming an image in said phosphor layer includes means for projecting a cathode ray beam thereon.

4. A display device as set forth in claim 1, wherein said means for forming an image in said phosphor layer includes transparent conductive strips on opposite surfaces of said phosphor layer.

5. A display device comprising:

a phosphor layer;

means for forming a light image in said phosphor layer;

a glass layer having a first surface facing said phosphor layer, and a second surface remote from said phosphor layer; and a graduated antireflection coating between said phosphor layer and said first surface, wherein the antireflection coating is graduated such that a surface of the antireflection coating adjacent the glass layer has an index of refraction substantially equal to the index of the refraction of the glass layer and an index of refraction throughout the graduated antireflection coating becomes substantially equal to an index of refraction of the second surface;

a second graduated antireflection layer on the second surface of said glass layer, wherein the antireflection coating is graduated such that a surface of the second graduated antireflection coating adjacent the glass layer has an index of refraction substantially equal to the index of the refraction of the second surface and an index of refraction throughout the second graduated antireflection coating becomes substantially equal to an index of refraction of air; and a focusing layer between said glass layer and said phosphor layer, wherein the focusing layer is comprised of a plurality of Fresnel lens having an open end of the Fresnel lens facing the phosphor layer so as to focus light emanating from the phosphor layer through the second surface to the air.

* * * * *